United States Patent [19]

Nagatsuna et al.

[11] Patent Number: 4,983,052

[45] Date of Patent: Jan. 8, 1991

[54] ADJUSTING VERTICAL LINE LENGTH IN FRAME PRINTER

[75] Inventors: Akemi Nagatsuna; Noriaki Kabeya, both of Nagoya, Japan

[73] Assignee: Brother Kogyo Kabushiki Kaisha, Aichi, Japan

[21] Appl. No.: 330,908

[22] Filed: Mar. 31, 1989

[30] Foreign Application Priority Data

Apr. 6, 1988 [JP] Japan ..... 63-84935

[51] Int. Cl.[5] ..... B41J 29/26

[52] U.S. Cl. ..... 400/17; 400/65

[58] Field of Search ..... 400/16, 17, 18, 21, 400/65

[56] References Cited

U.S. PATENT DOCUMENTS

| | | | |
|---|---|---|---|
| 4,488,827 | 12/1984 | Haganuma | 400/17 |
| 4,571,100 | 2/1986 | Ueno et al. | 400/17 |
| 4,820,069 | 4/1989 | Torii | 400/555 |
| 4,906,114 | 3/1990 | Tanaka et al. | 400/21 |

FOREIGN PATENT DOCUMENTS

| | | | |
|---|---|---|---|
| 174377 | 10/1984 | Japan | 400/17 |
| 159079 | 8/1985 | Japan | 400/17 |
| 201973 | 10/1985 | Japan | 400/76 |
| 60242088 | 12/1985 | Japan | 400/17 |
| 286177 | 12/1986 | Japan | 400/17 |
| 140867 | 6/1987 | Japan | 400/17 |
| 189186 | 8/1987 | Japan | 400/17 |

*Primary Examiner*—David A. Wiecking
*Assistant Examiner*—Steven S. Kelley
*Attorney, Agent, or Firm*—Oliff & Berridge

[57] ABSTRACT

A printer with a frame-printing function can automatically print out a frame with horizontal lines and vertical lines well-conformed to each other. The memory device of the printer stores externally input format data including data of line spacing, data of vertical line positions, and data of the number of horizontal lines. Based on these format data, the horizontal lines are printed first, and then the vertical lines are printed, so that the bottom end of each vertical line touches the bottom horizontal line without going beyond it.

8 Claims, 7 Drawing Sheets

ADJUSTING VERTICAL LINE LENGTH IN FRAME PRINTER

BACKGROUND OF THE INVENTION

1. Field of the Invention

The present invention relates to a printer that can print a frame with vertical lines and horizontal lines.

2. Prior Art

There are currently many typewriters that can print a frame as shown in FIG. 4A or 4B. One example is disclosed in Japanese Published Unexamined Patent Application No. S60-242088, with which an operator can make a frame by the following steps: (1) bring the printing head to a starting point of a paper; (2) press a vertical line key, and hold down a repeat key until a first vertical line reaches the needed length; (3) move the printing head to the next point on the sheet by operating a paper down key, space key, or the like, and operate the repeat key to print out a next vertical line; (4) repeat steps (1) & (2) until all the vertical lines are drawn; (5) return the printing head to the starting point by operating the paper down key, back-space key, or the like; (6) press a horizontal line key, and hold down the repeat key until the horizontal line reaches the far right vertical line; (7) move the printing head left to the first vertical line and down by a preset cell height by operating a return key, and hold down the repeat key to draw a next horizontal line; and (8) repeat step (7) until all the horizontal lines are drawn. If these lines are typed longer than required, a correction key is available for erasing the excessive part.

SUMMARY OF THE INVENTION

When an operator desires a just-fit corner of the frame, he or she should carefully adjust the ends of the horizontal lines and vertical lines. Especially for fitting the bottom corners in the prior-art typewriter, the operator has to calculate in advance how many times the vertical line type must be printed based on the number of cell rows, the cell height, and the unit vertical-line length. Such calculation is troublesome for the operator, especially when the cell height is not a multiple of the length of the vertical-line type. If the operator miscalculates it, the line will be printed longer or shorter than required, and if it is longer, the operator has to erase the excessive part of the line by using the correction key. Another problem is that the operator has to print all the lines one by one by using many keys, e.g., half-space key, paper down key, etc., which are seldom used during ordinary typing.

To solve these problems, the present invention provides a printer that can automatically print out a frame with vertical lines and horizontal lines with fitted corners and edges.

According to the printer of the present invention, as illustrated in FIG. 1, the horizontal-line printing means M5 and the vertical-line printing means M6 control the printing of the horizontal lines and the vertical lines, respectively, by operating the printing head M1 and the movement mechanism M2 based on externally input format data in the memory means M3. When the calculating means determines that the bottom ends of the vertical lines will not conform to the bottom horizontal line, the adjusting means M7 controls the movement mechanism M2 to adjust the bottom ends of the vertical lines to the bottom horizontal line.

DETAILED DESCRIPTION OF THE PREFERRED EMBODIMENT

Figure 1:
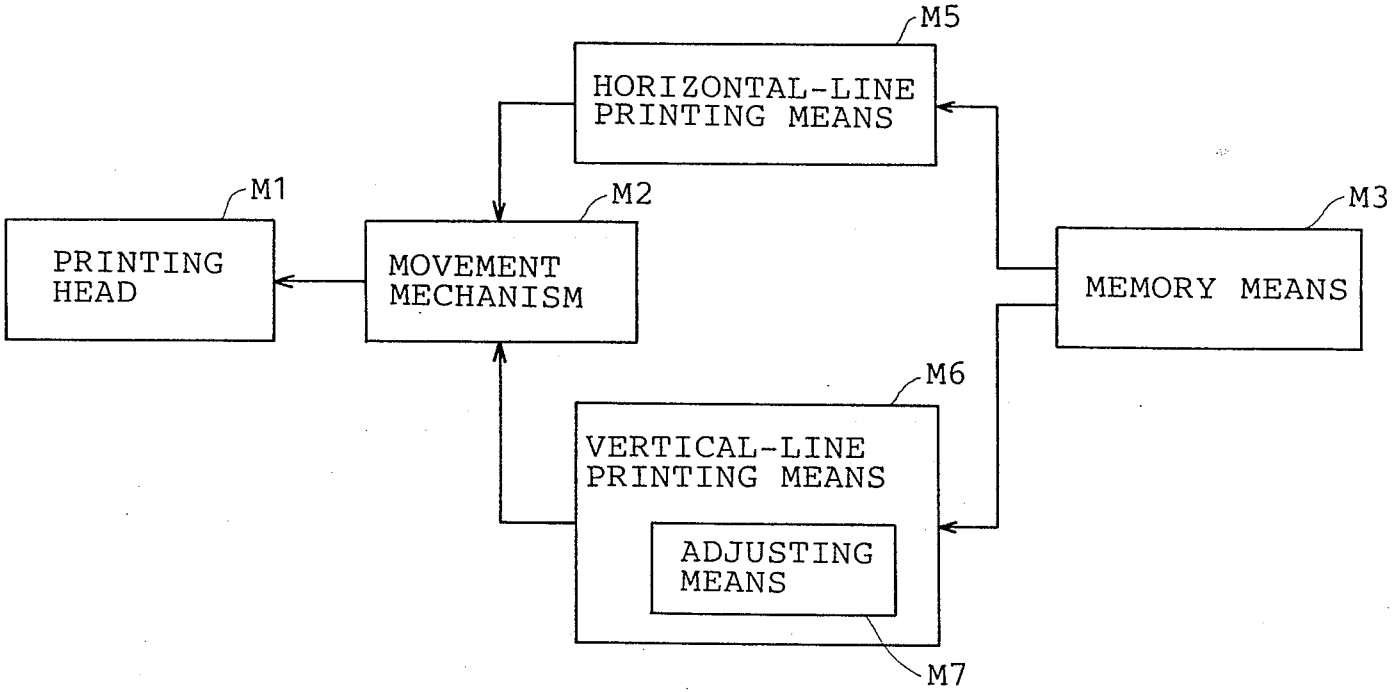
FIG. 1 is a basic diagram illustrating the present invention.

This is a description of the embodiment of the present invention shown in the drawings.

Figure 2:
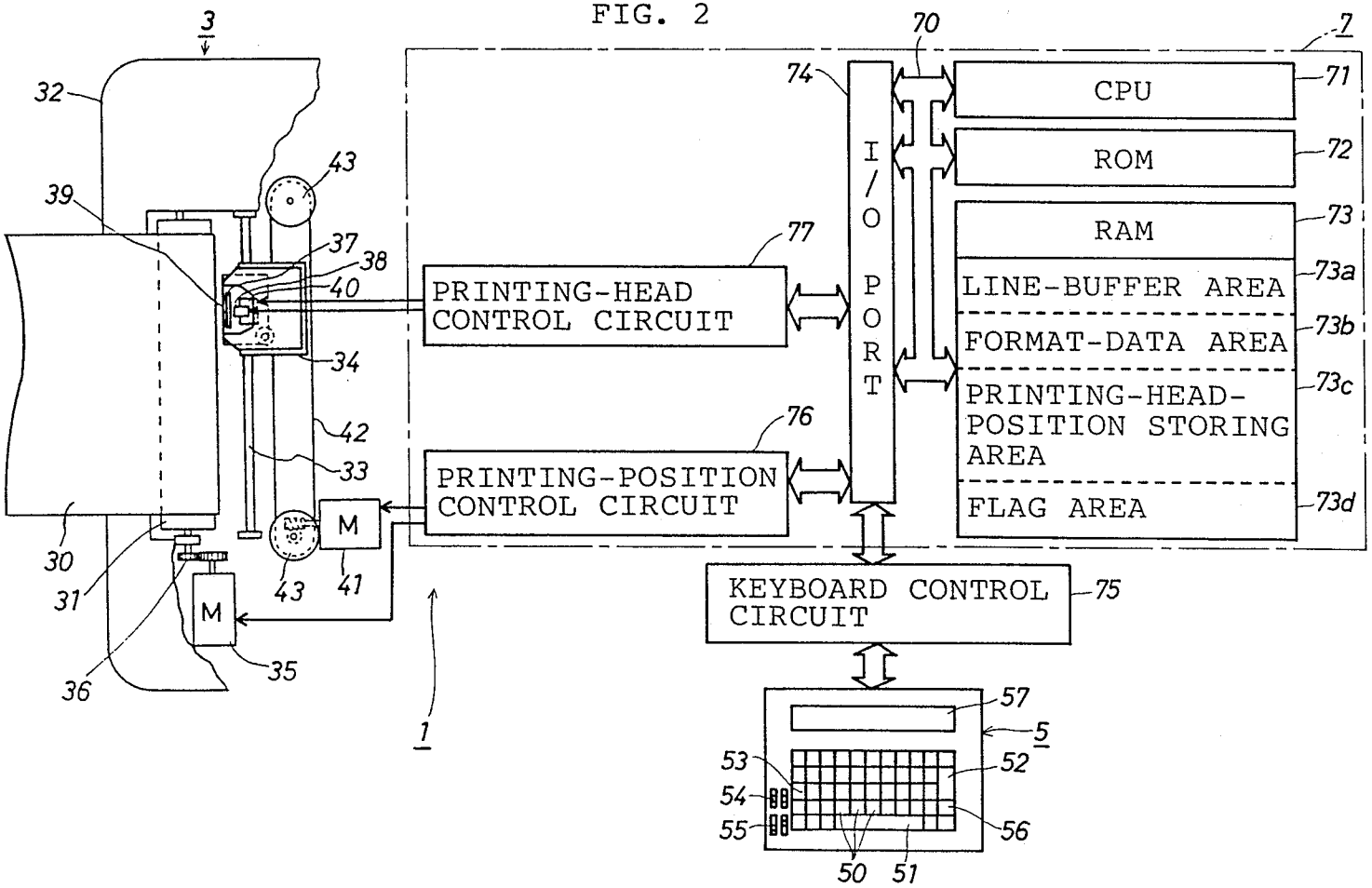
FIG. 2 is a schematic diagram of a typewriter according to one embodiment of the present invention.

As shown in FIG. 2, the typewriter 1 mainly consists of a printing mechanism 3, a keyboard 5 and an electronic control unit (ECU) 7. As for the printing mechanism 3, a platen 31 is rotatably installed in a frame 32 and a sheet of paper 30 is rolled around the platen 31. A carriage 34 held on a guide shaft 33 moves back and forth along the longitudinal direction of the platen 31. The platen 31 is driven by a line-feed step motor (hereafter described as LF motor) 35 via a gear mechanism 36, thus feeding the sheet 30 up and down by 1/12 inches.

The carriage 34 supports a printing head 40 including a type wheel 37 known as a daisy wheel and a print hammer 38, and a print ribbon 39. The type wheel 37 consists of a number of radiant spokes (not shown), each spoke having a printing type at its outer ends, the types including: letter types, numeral types, a vertical-line type, a horizontal-line type and so on. The horizontal-line type is actually an underline type. The type wheel 37 can be selected from: a wheel for pica pitch (1/10-inch pitch), a wheel for elite pitch (1/12-inch pitch), and a wheel for micron-space pitch (1/15-inch pitch). One of those type wheels is attached to the carriage 34.

Each vertical-line type of the different type wheels prints a unit vertical line that centers the printing position, and whose vertical length is equal to a basic line spacing LSf=1/6 inches. Each horizontal-line type, or underline type, prints a unit horizontal line that forms an upside-down T with the unit vertical line. The length of the unit horizontal line is equal to the pitch of the respective type wheel to print a continuous line.

The carriage 34 is laterally moved on the guide shaft 33 by a carriage step motor (hereafter described as CA motor) 41, a wire 42 and pulleys 43. The carriage 34 can move by 1/120 inches.

The platen 31, the carriage 34 and their respective driving mechanisms are regarded as the movement mechanism M2 in FIG. 1.

The keyboard 5 has character keys 50, including the vertical-line key, the underline key and numeral keys, a space key 51, a carriage return key 52, a tabulation key 53, a line-spacing selection switch 54, and a typing-pitch selection switch 55. By operating the line-spacing selection switch 54, a line spacing LS is selected among: 1.0 (the basic line spacing LSf for advancing the sheet by 1/6 inches every carriage-return); 1.5 (advancing ¼ inches); and 2.0 (advancing ⅓ inches). Similarly, by operating the typing-pitch selection switch 55, a typing pitch P is selected among the pica pitch, the elite pitch and the micron-space pitch, ordinarily according to a choice of the type wheel 37.

Additionally, the keyboard 5 of this embodiment has a frame print key 56 for starting the printing of a frame. When this key is operated, a frame illustrated in FIG. 4B, for example, is printed out: horizontal lines are printed with the distance equal to the selected line spacing LS, while vertical lines are printed at a left margin position LM and/or a right margin position RM and every tab position that is preset between both margins by the tabulation key 53. More detailed explanation will be given later. The keyboard 5 has a display panel 57 for indicating the input characters and some information to the operator.

The ECU 7 includes a known CPU 71, ROM 72, RAM 73 as the memory means M3, input/output port 74, bus 70 connecting the above elements, and many peripheral circuits connected with the input/output port 74. The peripheral circuits include: a keyboard interface circuit 75 for the keyboard 5 and the display panel 57; a printing-position control circuit 76 for the LF motor 35 and CA motor 41; and a printing-head control circuit 77 for the printing head 40.

The ROM 72 previously stores various programs for operating the typewriter 1 and various data such as default parameters for start up of the typewriter 1. The RAM 73 includes a line-buffer area **73*a*, a format-data area 73*b*, a printing-head-position storing area 73*c* and a flag area 73*d*. The line-buffer area 73*a* stores data of the input characters. The format-data area 73*b*** stores many kinds of format data, such as the line spacing LS, typing pitch P, left margin position LM, right margin position RM, tab position TAB (hereafter described as tab stop TAB), the number of tab stops TBN, and so forth.

The ECU 7 drives the LF motor 35 and CA motor 41 in response to the data sent from the keyboard 5, thus moving the printing head 40 horizontally and vertically on the sheet 30. Simultaneously, the ECU 7 drives the printing head 40 to execute printing. The ECU 7 includes the memory means M3, the horizontal-line printing means M5, and the vertical-line printing means M6 in FIG. 1.

Now, the process of frame-printing by the typewriter 1 is explained according to the flowcharts in FIGS. 3A through 3D.

When the frame print key 56 is pressed, the CPU 71 starts the following frame printing process. First, it is determined at step S1 if each distance between the left margin LM and the tab stops TAB can be divided by the current typing pitch P without generating a fraction. If it is so, the CPU 71 waits at step S2 until the operator inputs the number of rows LN of the frame from the keyboard 5 (LN=3 in case of FIG. 4B). If it is determined NO at step S1, it means that the right ends of the horizontal lines will not conform to the far right vertical line. In this case, some measures are taken for indicating an error at step S17: for example, the display panel 57 shows a message that any tab stops TAB or the typing pitch P should be altered.

When the operator inputs the number of rows LN, step S2 is followed by step S3 where the CPU 71 instructs the printing position control circuit 76 to operate the CA motor 41 to move the printing head 40 to a position half the typing pitch P right of the left margin position LM (i.e., LM+½P). As a result, the left end of a horizontal line will touch the first vertical line at the left margin position LM and the right end will touch the last vertical line at the right margin position RM or the far right tab stop TABend.

After step S3, it is determined at step S4 if the far right tab stop TABend is located beyond the right margin position RM. If it is not, the program flow goes to step S5 for calculating: the number Nph of necessary horizontal-line units to print a continuous horizontal line from the left margin position LM to the far right tab stop TABend by $Nph=(TABend-LM)/P$; and the number Nh of horizontal lines by $Nh$ LN+1. Every time the unit horizontal-line is printed on the sheet 30 at step S6, it is determined at step S7 if the unit horizontal-line has been printed as many as the number Nph. If not, the printing head 40 is moved to the right by one typing pitch P at step S8 to continue the printing of the horizontal line at step S6.

Figure 3A:
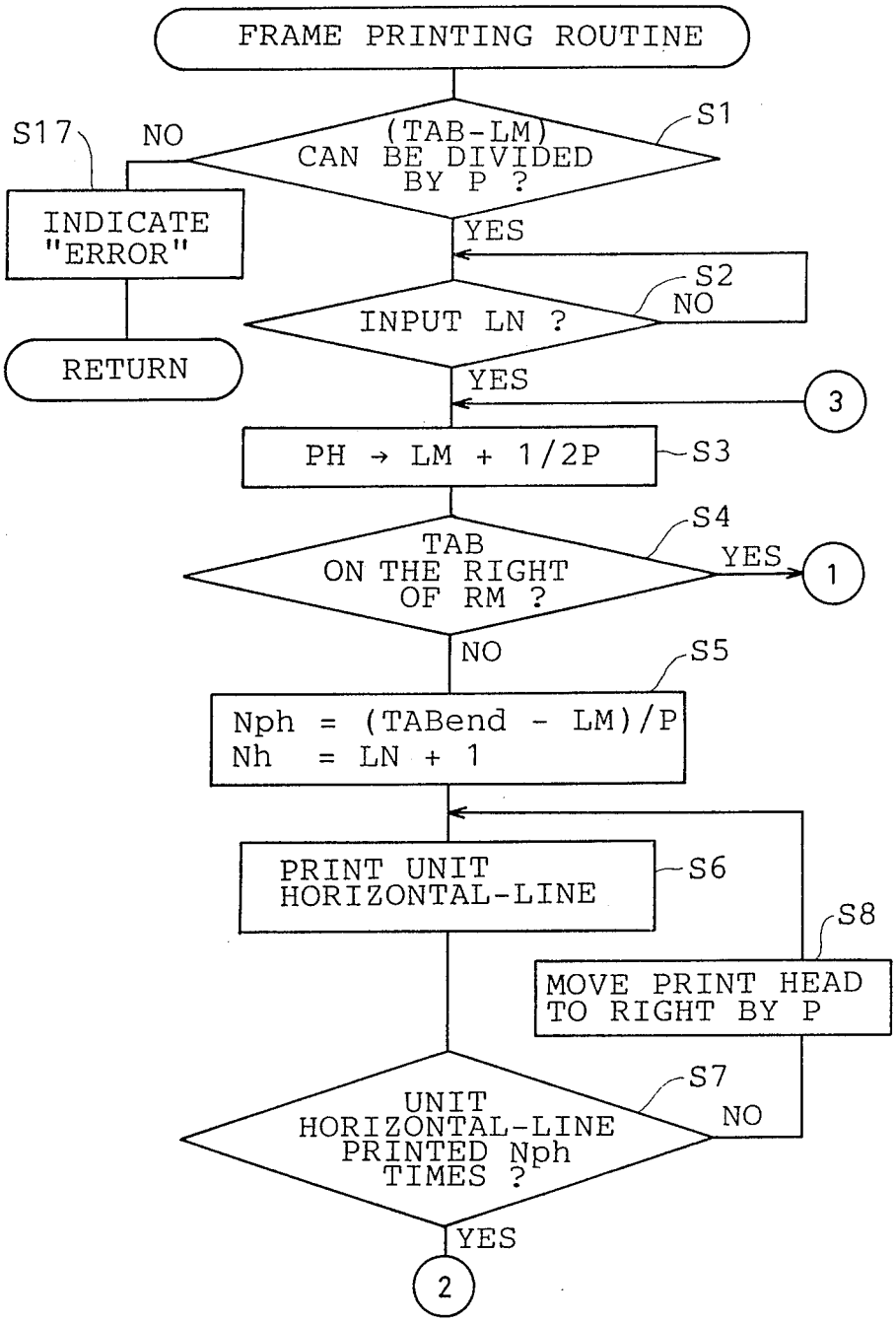
FIGS. 3A, 3B, 3C and 3D are flowcharts describing the frame-printing process.
Figure 3B:
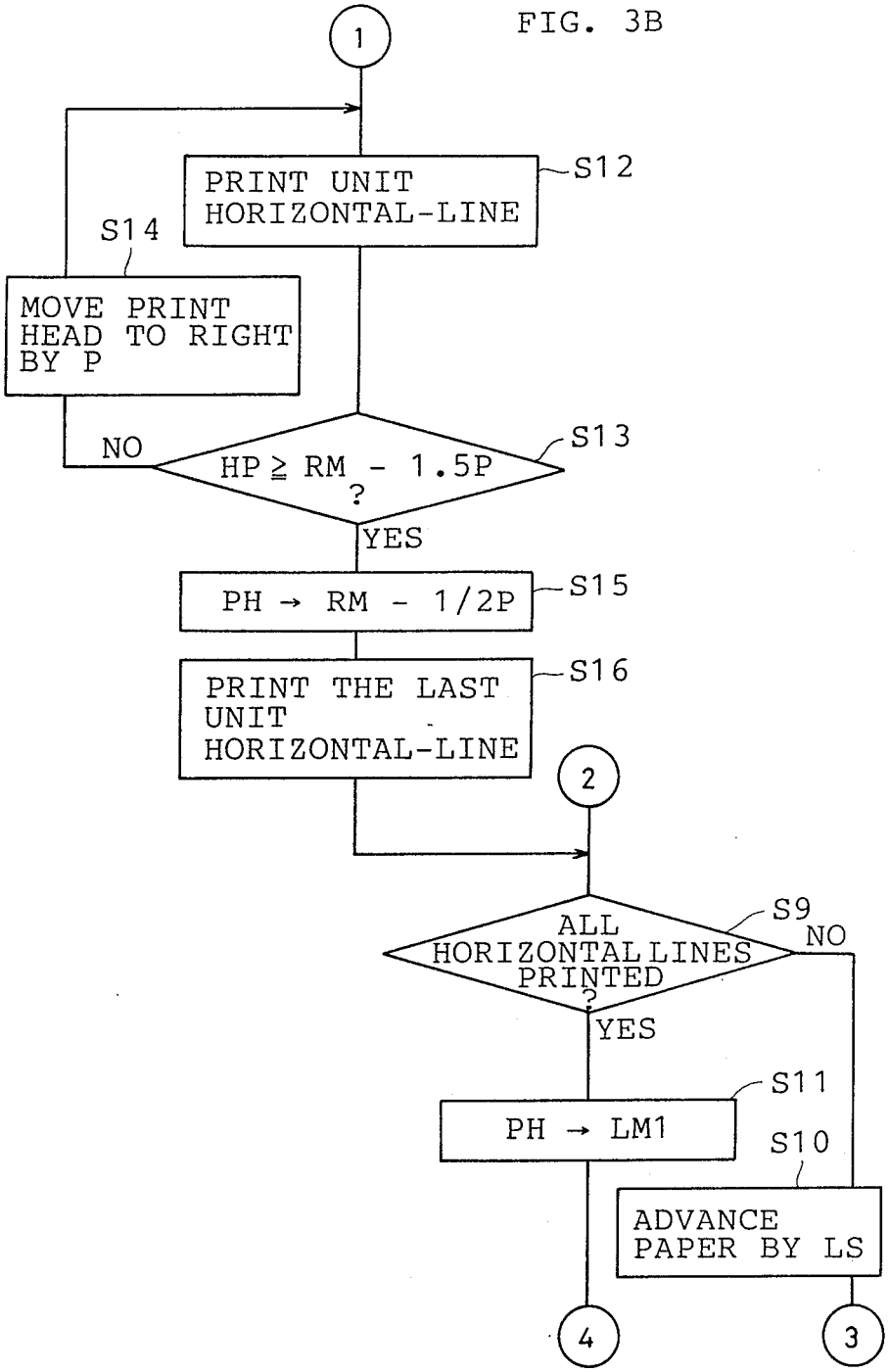
Figure 3C:
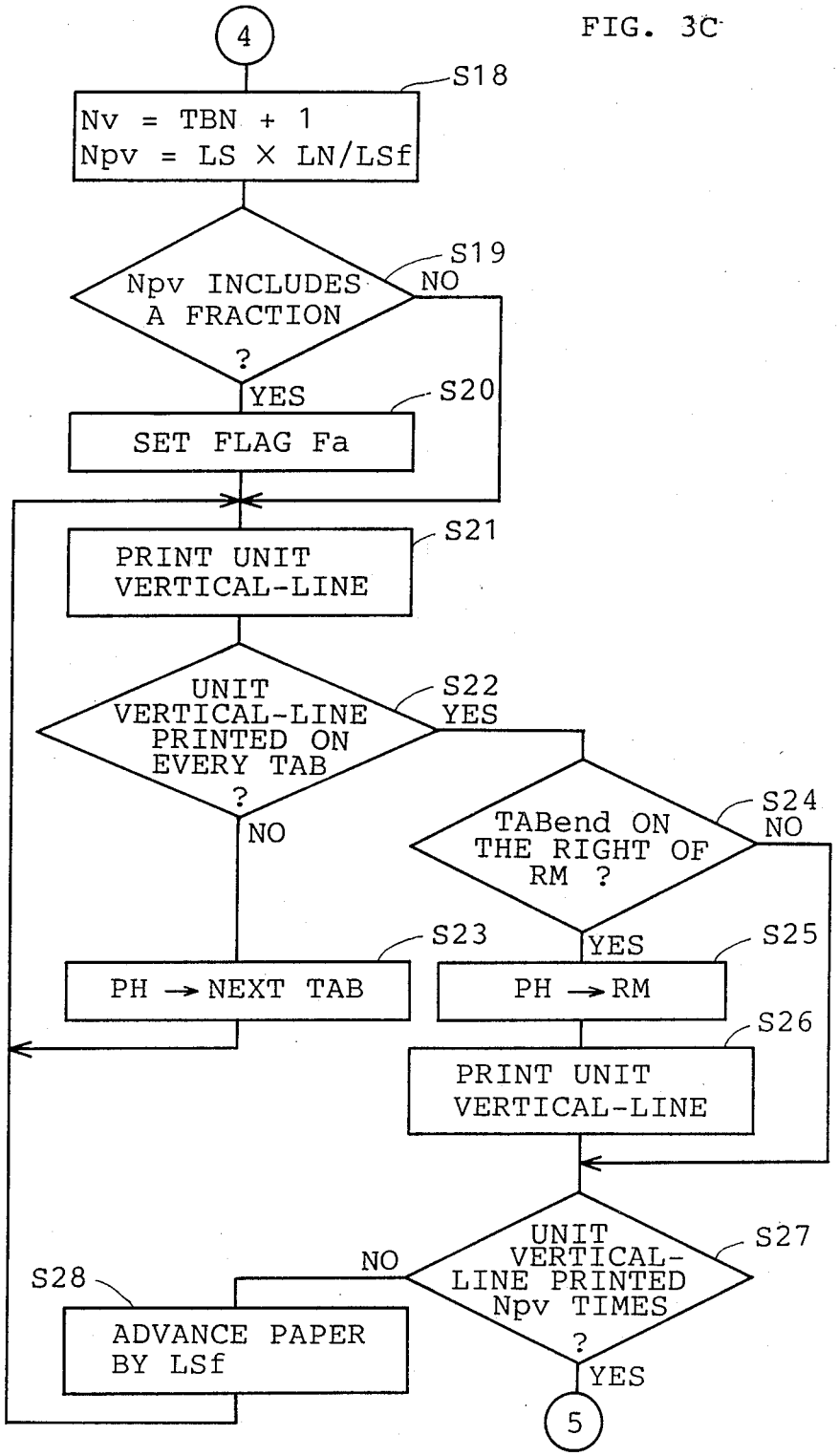

If the answer at step S4 is yes, which means that the horizontal line is to be printed as far as the right margin position RM, the program goes to step S12 in FIG. 3B. Every time the unit horizontal-line is printed on the sheet 30 at step S12, it is determined at step S13 if the current printing head position HP($HP=LM+\frac{1}{2}P+P\cdot$(the number of printed horizontal-line unit) exceeds the position RM−3/2P. If it is determined NO at step S13, the printing head 40 is moved to the right by one typing pitch P at step S14, and the flow goes back to step S12. When it is finally determined YES at step S13, the printing head 40 proceeds by one typing pitch P to the position RM−½P at step S15, and prints the last unit horizontal-line at step S16.

Figure 4A:
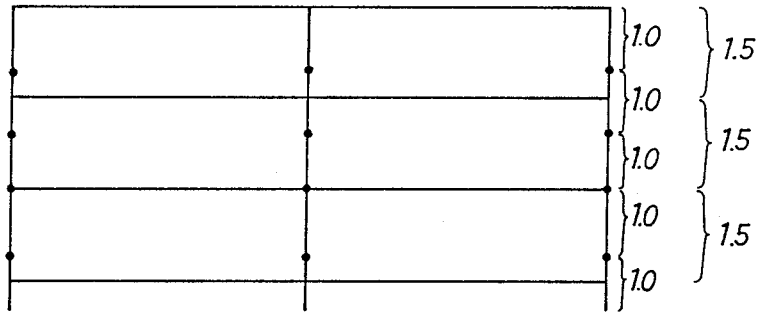
FIG. 4A is one example of a frame typically made by the prior-art typewriter.
Figure 4B:
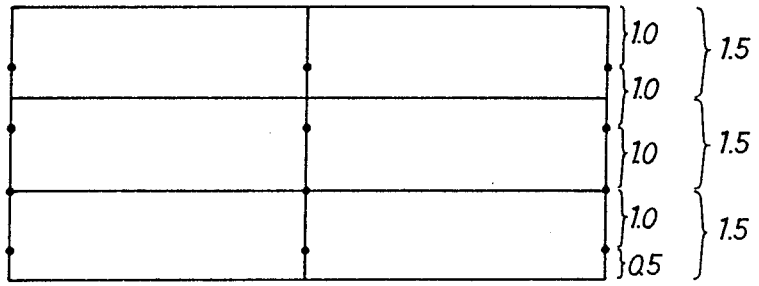
FIG. 4B is another example made by the typewriter of the present embodiment.

After YES at step S7 or the procedure at step S16 meaning that a horizontal line of the required length has been printed, the flow goes to step S9 for determining if the number of the printed horizontal lines becomes the number Nh. If it is determined NO at step S9, the carriage 34 returns at step S10 and the sheet 30 advances by the selected line spacing LS. Then, the flow goes back to step S3 to repeat the procedures of steps S3–S9 until the answer at step S9 is YES indicating that all the horizontal lines are printed on the sheet 30. If so, the CPU 71 instructs the printing position control circuit 76, at step S11, to advance the sheet 30 backward by (LN−1)·LS and position the printing head 40 at a position LM1 on the left margin position LM as shown in FIG. 4B. As described before, the lower end of the vertical-line type on the type wheel 37 is located at the same level as the horizontal-line type. Therefore, to start the vertical line exactly below the first horizontal line, the printing head 40 should be moved the basic line spacing LSf (=unit vertical-line length) lower than the printing line of the first horizontal line.

After step S11, at step S18 (FIG. 3C) are calculated the number Nv of vertical lines of the frame and the repetition Nph for printing the vertical-line unit necessary for making the full length of each vertical line: the number Nv is obtained by adding 1 to the number TBN of tab stops ($Nv=TBN+1$), and the repetition Npv is obtained by multiplying the line spacing LS by the amount LN of rows and dividing this product by the length of the vertical-line unit, i.e., the basic line spacing LSf ($Npv=LS\times LN/LSf$). In case of making a frame illustrated in FIG. 4B, Nv=4+1=5, and Npv=1.5×3/1.0=4.5.

After the calculation at step S18, it is determined at step S19 if the calculated number Npv includes a fraction as is the above example. If so, the fraction is omitted and a bottom adjustment flag Fa, described later, is set at step S20. After this step S20 or the negative decision at step S19, the CPU 71 instructs the printing position control circuit 76 and the printing control circuit 77, at step S21, to print the unit vertical-line according to the result at step S18 and position data of the tab stops. Every time the unit vertical-line is printed, it is determined at step S22 if the unit vertical-line has been printed at every tab stop position on the in-process printing line, based on the number Nv. If not, the CPU 71 instructs the printing position control circuit 76, at step S23, to move the printing head 40 horizontally to the next tab stop, thus successively printing the unit vertical-line at every tab stop by repeating steps S21–S23.

If the answer at step S22 is yes, it is then determined at step S24 if the far right tab stop TABend is located beyond the right margin position RM. If so, the printing head 40 is moved to the right margin position RM, at step S25, to print the unit vertical-line for the far right vertical line on the right margin position RM at step S26. After step S26 or the negative decision at step S24, it is determined at step S27 if the unit vertical-line has been printed Npv times at every tab stop and/or the right margin position RM. If not, the sheet 30 is advanced for the basic line spacing LSf and the printing head 40 is moved to the left margin position LM at step S28. Thereafter, the process at steps S21 through S26 is repeated until it is determined YES at step S27.

Figure 3D:
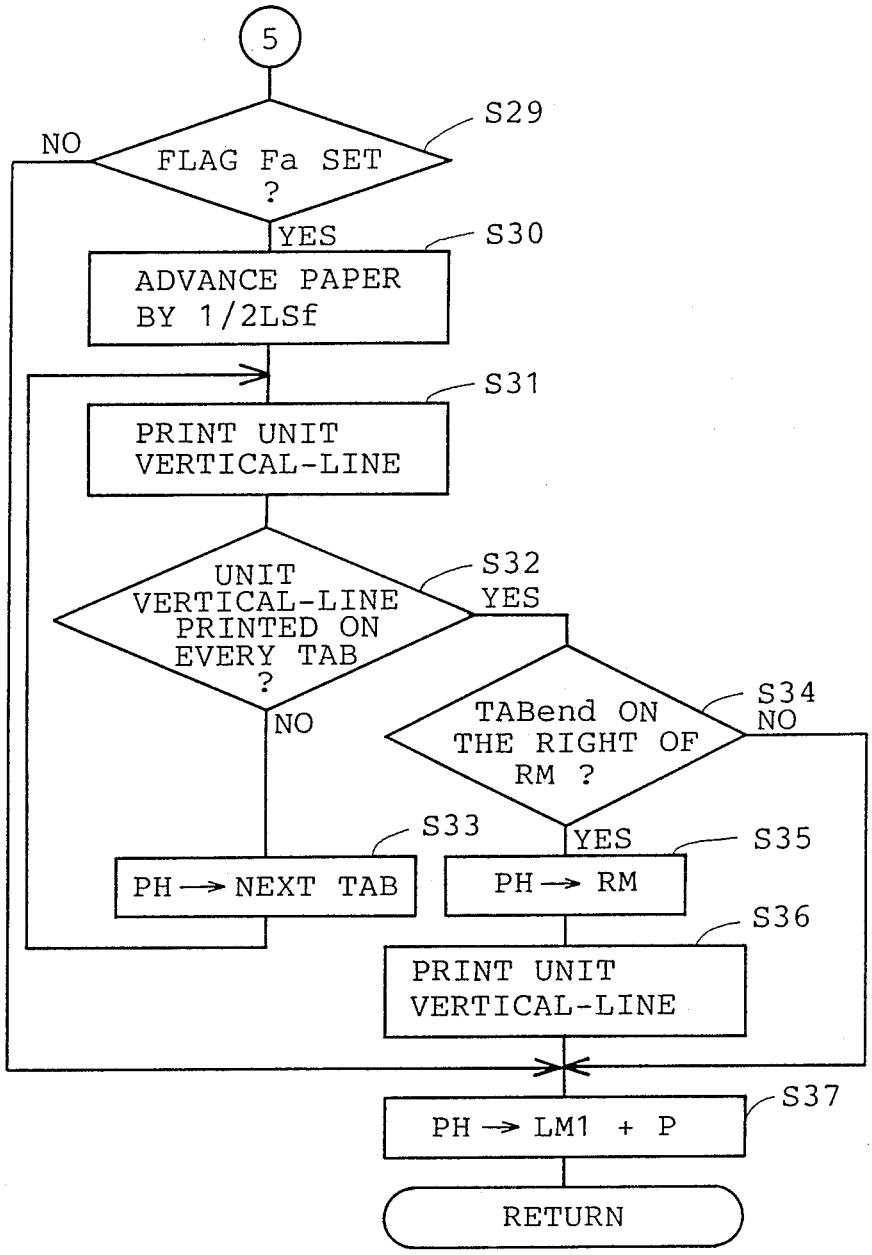

After the positive decision at step 27, it is determined at step S29, in FIG. 3D, if the bottom adjustment flag Fa has been set at step S20. If so, the CPU 71 instructs the printing position control circuit 76 to move the printing head 40 to the left margin position LM and to advance the sheet 30 by half of the basic line spacing LSf at step S30 (See FIG. 4B). After this, the unit vertical-line is printed at every tab stop and/or the right margin position RM throughout the in-process printing line at steps S31 through S36 just in the same way as the previous steps S21 through S26 in FIG. 3C, thus finishing the bottom portion of each vertical line. As a result of these operations at steps S30 and S31, the bottom end of each vertical line touches the bottom horizontal line without going beyond it as shown in FIG. 4A.

When the desired frame is completed after the processing at step S36 or the negative decision at step S29 or step S34, the CPU 71 instructs the printing-position control circuit 76, at step S37, to move the printing head 40 to the position one typing pitch P right of the above-mentioned position LM1 in the same manner as step S11, and then the control routine ends here.

To print a frame having many cells, the operator only needs to designate the number of rows LN from the keyboard 5 and press the frame print key 56. As a result, the typewriter 1 automatically prints out on the sheet 30 a neat frame in which the left and right ends of each horizontal line conform to the vertical lines on the left and right sides respectively and the bottom of every vertical line touches the bottom horizontal line without going beyond it. The operator, therefore, does not need to count how many times the unit vertical-line should be typed on the sheet based on the unit vertical-line length and the needed length of the vertical line. In addition, since every vertical line is exactly printed out for the required length, the operator does not have to use the correction key to erase any excessive portion as in the prior-art typewriter. This invention enables the typewriter to print out a frame more precisely, and much quicker and easier than the prior-art printer.

If the typewriter 1 can vertically retreat the printing head 40 by half of the basic line spacing LSf each time, the printing head 40 is moved to the designated point at steps S11 and S37 by moving the sheet 30 down $(LN \times LS \times 2-2)$ times.

In the present embodiment, a horizontal line is printed from the left margin position LM to the far right tab stop TABend by previously calculating the typing time of the unit horizontal-line (steps S5 through S8). Alternatively, the horizontal line from LM to TABend may be printed just in the same manner as steps S12 through S16: every time the unit horizontal-line is typed, it is determined if the printing head 40 has passed the target finish point. In this method, the determined length of a horizontal line can be obtained even when the typing pitch P cannot integrally divide a distance between LM and TABend.

This embodiment assumes that the horizontal line is printed from the left margin position LM to the far right tab stop TABend, but it is also possible to redesign the control routine to draw horizontal lines from the left margin LM to the right margin RM instead of TABend. This can omit the processing steps S4 through S8, and the step S3 is followed by step S12.

This is just one embodiment of the present invention. The claim is not limited to any of the details of this description, and should be construed broadly within its general principles.

What is claimed is:

1. A typewriter with a keyboard including a frame print key for printing a frame on a sheet by printing horizontal lines at a fixed distance and vertical lines at present positions, using a printing head including printing types of a unit horizontal-line and a unit vertical-line, and a movement mechanism for effecting relative horizontal and vertical movements respectively equal to the lengths of the unit horizontal-line and the unit vertical-line between the printing head the sheet, the printer comprising:

memory means for storing externally input format data of the frame including data of the vertical line positions, data of the fixed distance, and data of the number of rows in the frame;

means for printing the horizontal lines using the horizontal-line printing type and the movement mechanism according to the stored fixed-distance data; and vertical line printing means including:

a determination/calculation means for determining based on the data stored in the memory means according to pressing of the frame print key whether a distance from a starting point of the vertical-line to the horizontal-line contacting at a final portion of the vertical-line is an integer multiple of the unit vertical-line length and for calculating a mismatch amount smaller than the unit vertical-line length when the distance is not the integer multiple of the unit vertical-line; and control means for controlling the movement mechanism so that the printing head prints a vertical line to have a length equal to the integer multiple of the unit vertical-line length when the determination/calculation means determines the distance to be an integer multiple of the unit vertical-line length, and for controlling the movement mechanism so that the printing head prints a vertical line to have a length equal to an integer multiple of the unit vertical-line length as well as the mismatch amount when the determination/calculation means determines that the distance is not an integer multiple of the unit vertical-line length.

2. The printer, as in claim 1, wherein the vertical-line printing means comprises:

means for calculating out an integer part and a fraction part of (the fixed distance)·(the number of rows)/(the unit vertical-line length); and wherein the control means controls runs the movement mechanism vertically by an amount equal to the fraction part.

3. The printer, as in claim 1, wherein the printer comprises mode selecting means for selecting a normal printing mode, and a frame printing mode for printing the frame.

4. The printer, as in claim 3, wherein the printer further comprises a line spacing selection switch for selecting a spacing distance between character lines in the normal printing mode, and for selecting the fixed distance in the frame printing mode.

5. The printer, as in claim 4, wherein the vertical-line printing means comprises:

means for calculating out an integer part and a fraction part of (the fixed distance)·(the number of rows)/(the length of the unit vertical-line); and wherein the control means controls the movement mechanism to effect relative movement by an amount equal to the fraction part.

6. The printer, as in claim 5, further comprising means for inputting format data of the vertical line positions comprising means for defining a left margin position, tab positions and a right margin position.

7. The printer, as in claim 1, wherein the unit horizontal-line type and the unit vertical-line type are arranged to print an upside-down T.

8. The printer, as in claim 7, wherein the horizontal-line printing means starts printing the unit horizontal-line from the left margin position plus half the unit horizontal-line length to adjust the left end of the horizontal lines on the left-most vertical line.

* * * * *